United States Patent [19]

Garnett

[11] 4,048,679

[45] Sept. 20, 1977

[54] TOILET SEAT

[76] Inventor: Wayne A. Garnett, 1810 Oliver Ave. North, Minneapolis, Minn. 55411

[21] Appl. No.: 633,274

[22] Filed: Nov. 19, 1975

Related U.S. Application Data

[63] Continuation of Ser. No. 486,447, July 8, 1974, abandoned.

[51] Int. Cl.[2] ..... A47K 13/00

[52] U.S. Cl. ..... 4/237

[58] Field of Search ..... 4/1, 112, 113, 234, 4/237, 217, 98, 239, DIG. 6, DIG. 8; D23/71; 297/199, 201, 202; 128/68

[56] References Cited

U.S. PATENT DOCUMENTS

| | | | |
|---|---|---|---|
| 2,256,994 | 9/1941 | Warshaw | 4/237 |
| 3,772,111 | 11/1973 | Ginsburg | 4/234 X |
| D. 45,134 | 1/1914 | Waltensperger | 4/237 X |

FOREIGN PATENT DOCUMENTS

| | | | |
|---|---|---|---|
| 4,987 | 9/1905 | France | 4/234 |

OTHER PUBLICATIONS

The Bathroom, Criteria for Design pp. 62–73 by A. Kira copyright 1966 Cornell Univ. N.Y. Lib. of Congress Catalogue Card No. 66-17889.

*Primary Examiner*—Richard E. Aegerter
*Assistant Examiner*—Stuart S. Levy
*Attorney, Agent, or Firm*—Burd, Braddock & Bartz

[57] ABSTRACT

A toilet seat of the type having a central opening located over a toilet bowl. The toilet seat employs means for the support of the ischial tuberosities as well as the sacrum of a person situated thereon to promote the comfort of the user and in particular those having proctological difficulties. Unnecessary strain normally imposed upon pelvic muscles in the use of a conventional toilet seat is relieved.

4 Claims, 5 Drawing Figures

TOILET SEAT

This application is a continuation of application Ser. No. 486,447, filed July 8, 1974, now abandoned.

BACKGROUND OF THE INVENTION

Conventional toilet seats are comprised of a horizontal base having a relatively large central opening located over the toilet bowl. The large size of the opening on conventional toilet seats does not permit a person situated thereon to be posteriorly supported on those members usually used in sitting, namely the two ischium or ischial tuberosities and the sacrum. The person thus usually relies upon the trochanter bones forming a part of the upper femur together with a contraction of muscles about the pelvic floor for support. the unrelaxed state of these muscles causes the bowel movement to be unnecessarily difficult. In particular, difficulties are encountered by persons with proctological problems such as hemorrhoids, following surgery, and the like.

SUMMARY OF THE INVENTION

The invention relates to an improved toilet seat to promote the comfort and well being of the user thereof. The toilet seat provides support for the primary triangular support region of the posterior of a person in a sitting orientation, defined by the ischial tuberosities or ischium and the base of the spine or the sacrum. The toilet seat is conventionally locatable over a toilet bowl and has a substantially flat base hingedly attachable to the toilet bowl. The base defines a central opening generally shaped as an elongate oval or ellipse. Toward the rear of the central opening, the base has a pair of mutually opposed protrusions or ischium support members projected laterally inward of the central opening toward one another. The ischium support members are located in a position to engage the ischial tuberosities of a person situated on the toilet seat while the sacrum is supported by the rear portion of the base. Unnecessary strain imposed upon the muscles of the pelvic floor by the usual toilet seat is relieved. The toilet seat is not only more comfortable for the general user thereof, but in particular provides an added measure of comfort for those having proctological difficulties. The toilet seat of the invention also facilitates the toilet training of young children.

An object of the invention is to provide a more comfortable toilet seat than those of the prior art. A second object of the invention is to provide a toilet seat to allow relaxation of the muscles of the pelvic floor and yet provide adequate support for the user thereof. A further object of the invention is to provide such a toilet seat which provides support for the support triangle of the posterior of a person defined by the ischial tuberosities and the sacrum. Further objects of the invention will become apparent upon the following description.

IN THE DRAWINGS

DESCRIPTION OF PREFERRED EMBODIMENTS

Figure 1:
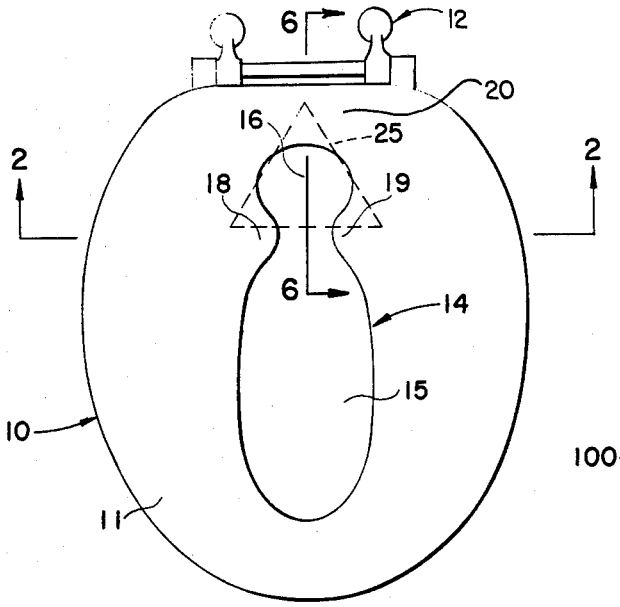
FIG. 1 is a top plan view of a toilet seat constructed according to the present invention.

Referring to the drawings, there is shown in FIG. 1 a toilet seat 10 constructed according to the present invention having a base 11 and a hinge assembly 12 secured at the back of base 11 for pivotal mounting in conventional fashion to the typical toilet bowl (not shown). The outer perimeter of base 11 is shaped as a usual toilet seat, being generally oval and slightly wider or of greater transverse dimension toward the rear than the front.

Figure 2:
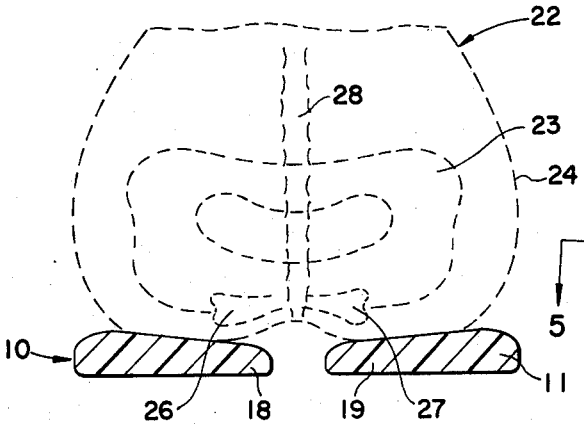
FIG. 2 is a sectional view taken along the line 2—2 of FIG. 1 and indicating in phantom a person situated thereon.

Base 10 is provided with a central opening 14 constituted as an elongate, narrow, oval or ellipse, having a transverse dimension somewhat less than that of a conventional toilet seat opening. The front of base 11 of toilet seat 10 may or may not be open to the central opening 14, and, as shown in FIG. 1, is of the closed variety. The rearward portion of central opening 14 is restricted by a pair of inwardly projected support members 18, 19 which divide central opening 14 generally into a forward opening 15 and a rear opening 16. Support members 18, 19 are mutually opposed, extending transversely into central opening 14 and comprise a continuous extension of the upper surface of base 11, being substantially coplanar therewith. Support members 18, 19 together with the most rearward portion 20 of base 11 provide support for the posterior of a person 22 situated on toilet seat 10. The supporting members 18 and 19 and back portion 20 have upper surfaces that are located generally in the same horizontal plane. In other words, the surfaces which support the person are located at the same elevation so that they will simultaneously engage the ischium and the base of the spine. The top supporting surfaces of the support members 18 and 19 and the back portion have the same inwardly inclined slope, as shown in FIG. 2. This provides for even and concurrent engagement of the ischium and the base of the spine of the body resting on the seat, as shown in broken lines in FIG. 2. Support members 18 and 19 in conjunction with the rear portion 20 of the seat form a triangular supporting arrangement indicated by the broken line 25 for the ischium and the base of the spine.

The bones of the pelvis 23 which are normally used when a person 22 is in a sitting position are the ischium 26, 27 and the base of the spine 28, or the sacrum. the ischium is the dorsal and posterior of the three principal bones comprising either half of the pelvis. The structure of the human pelvis 23 varies little from one individual to the next. The iischium on either half of the pelvis together with the base of the spine form an isosceles triangle 25 approximately 3 × 5 × 5. The female pelvis typically varies only slightly from that of the male pelvic structure, being approximately ½inch greater on either side of the triangle formed by the two ischium and the base of the spine. In the normal sitting position, the body of the seated person is supported by the triangle 25 defined by these bones.

Referring again to FIG. 1, the support members 18, 19 are purposefully located on base 11 to provide support for the ischium 26, 27 on either side of the pelvis of a person situated on toilet seat 10 while the back section 20 of base 11 supports the base of the spine. The configuration not only offers support but is also conducive to good posture. The person thus situated on the seat 10 is comfortably supported in a normal sitting orientation with a relaxation of the pelvic and related muscles, to facilitate movement of the bowels.

Referring to FIG. 2, there is shown the posterior skeleton skin of a primate, indicated generally at 22, having pelvic bone structure 23 and the usual skin 24, situated on seat 10. The lower posterior portion of the pelvic bones form the ischium or ischial tuberosities 26 and 27 which along with the base of the spine 28 form bearing points which form the support triangle to support the posterior of the seated individual. The upper surface of base 11 of seat 10 forms the usual inwardly sloping configuration terminating in the support members 18 and 19 projected into central opening 14. The ischial tuberosities 26, 27 are located over and supported by the support members 18 and 19 whereby the person is situated on seat 10 in a normal, comfortable orientation. Such orientation not only facilitates bowel movements of normal individuals, but is particularly helpful to those having proctological difficulties, such as hemorrhoids, following surgery, or the like. Strain on the rectal area is practically eliminated. In addition, the seat 10 is useful in the toilet training of children as the child feels secure seated on the seat 10. The reduced dimensions of the seat 10 causes elimination of the unstable feelings experienced by the child when seated on the conventional toilet seat.

In practice, a seat 10 having the following dimensions of central opening 14, has proven satisfactory: longitudinal dimension of forward central opening 15 — 7 ½ inches; longitudinal dimension of rearward central opening 16 — 3 ½ inches; transverse dimension between the extremities of support members 18 and 19 — 1 ½ inches; maximum transverse dimension of forward central opening 15 — 4 ½ inches; maximum transverse dimension of rearward central opening 16 — 3 ½ inches; and longitudinal distance between the rear edge of rearward central opening 16 and the rear edge of base 11 — 2 ¼ inches.

Figure 3:
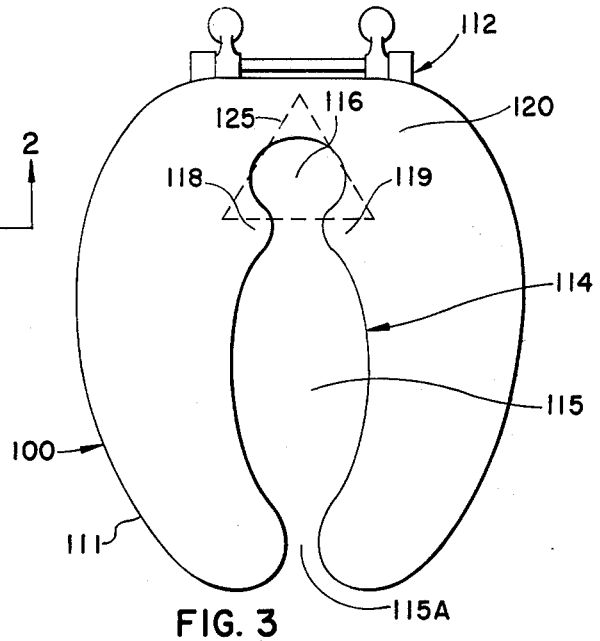
FIG. 3 is a top plan view of a toilet seat according to a second embodiment of the invention.

Referring to FIG. 3, there is shown a second embodiment of the toilet seat of the invention, indicated generally at 100. The toilet seat 100 is similar to the toilet seat shown in FIGS. 1 and 2. The forward portion of the seat 100 has an opening 115A similar to a conventional toilet seat. The seat 100 has a base 111 secured to hinge structure 112. The hinge structure 112 is conventional structure used to mount the toilet seat on a toilet bowl or water closet. Base 111 has an elongated generally oval elliptical shaped opening 114. Opening 114 is restricted by a pair of inwardly projected support members 118 and 119. The support members divide the opening 114 generally into a forward opening 115 and a rearward opening 116. Support members 118 and 119 are mutually opposed, extending transversely into central opening 114. Support members 118 and 119 have upper surfaces located in the same general plane as the back portion 120 and comprise continuous extensions of the upper surface of the base 111. The support members 118 and 119 together with the rear portion 120 of base 111 provide for the support of the posterior of a person situated on the seat 100. The support members 118 and 119 in conjunction with the rear portion 120 of the seat 129 form a triangular supporting arrangement, indicated by the broken line 125 for the ischium and the base of the spine of the person. In other words, support members 118 and 119 and rear portion 120 provide three separate support areas arranged at the corners of a triangular outline. The relationship between the person and the seat of FIG. 3 is the same as described with reference to FIGS. 1 and 2.

Figure 4:
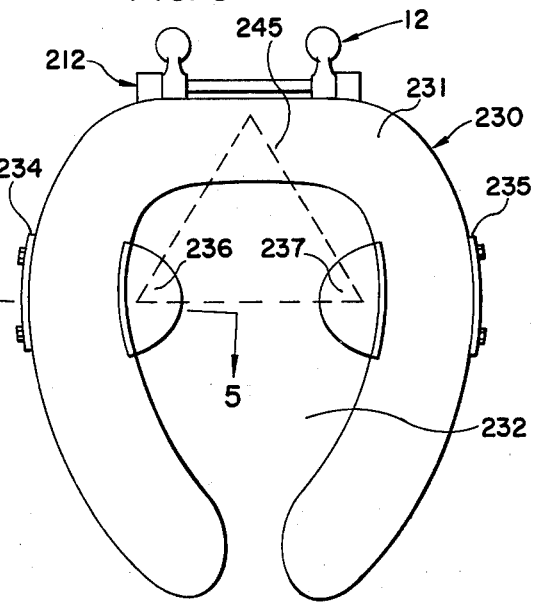
FIG. 4 is a top plan view of a toilet seat according to a third embodiment of the invention.
Figure 6:
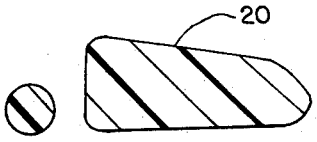
FIG. 6 is a sectional view taken along the line 6—6 of FIG. 1.
Figure 5:
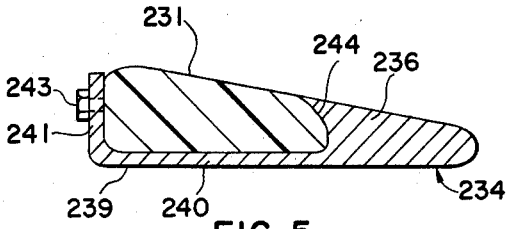
FIG. 5 is a sectional view taken along the line 5—5 of FIG. 4.

There is shown in FIGS. 4 and 5 a third embodiment of a toilet seat according to the present invention comprising a modification of a conventional toilet seat to achieve the advantages of the present invention. A conventional toilet seat 230 has a base 231 defining the usual generally oval central opening 232. Base 231 is generaly horseshoe-shaped, being of the variety open at the forward portion to central opening 232. Secured to opposite sides of the base 231 are support structures 234, 235, each having a support member 236, 237 transversely projected into central opening 232.

Referring to FIG. 5, there is shown in section the support structure 234 secured to a portion of base 231. As each support structure is identical in construction, only the support structure 234 need be described. Support structure 234 includes the support member 236 and a clamp assembly 239 to secure the support structure 234 to the base 231. Clamp assembly 239 has a leg 240 attached to the support member 236 and extending under the base 231 to an upstanding arm 241 located immediately adjacent the outside perimeter of base 231. A suitable fastener, as a bolt 243, passes through the arm 241 into base 231 to secure the support structure 234 securely to the seat 230. The support structures 236 and 237 can be adjustably positioned on the side members of seat 230. This is achieved by removing bolts 243 and repositioning the support structures relative to the seat. Bolts 243 are replaced to hold the support structures in their adjusted position. The portion of support member 236 immediately adjacent the inner edge of base 230 is contoured as at 244 to fit around the inner edge of base 231 and effect a smooth continuous interface between the upper surface of base 231 and the surface of support 236.

Referring again to FIG. 4, support members 236, 237 are symmetrically placed on base 231, being mutually opposed and projecting transversely inward into central opening 232. Support members 236, 237 are located in the rearward portion of the central opening 232 and project therein a sufficient distance to form the approximate triangular relationship with the rear portion 245 of the base 231 as was earlier described relative to support members 18, 19 and rear portion 20 of the seat 10 of FIG. 1. That is, support members 236 and 237 are purposefully located to engage the posterior of a person situated thereon in supporting relationship to the ischial tuberosities while the sacrum is supported on the rear portion 245 of base 231. The upper supporting surfaces of support members 236 and 237 are located in the same general horizontal plane as the supporting surface of the midsection of the back portion 231 of the base. This insures that there will be simultaneous and substantially balanced triangular contact between the body and the supporting members 236 and 237 and back portion 231 of the seat. The aforementioned advantages are achieved, namely maintenance of good posture and relaxation of pelvic muscles to facilitate bowel movements, and in particular, greater comfort for individuals with proctological difficulties.

The outer dimensions of the seats 10, 30 and 100, shown in FIGS. 1, 3, and 4, are the same as those of conventional seat means. This permits the use of the same seat cover with the seats of the invention. The seat aids in the initial toilet training of children. The internal dimensions are reduced so that a child can use the seat without fear of falling in or the unstable feeling of hanging on the edge. This eliminates the need for a "potty chair".

The seat of the invention as shown in FIGS. 1 through 5 can be constructed on any conventional materials, such as wood, wood laminated with plastic, solid plastic or padded materials. For example, the seat can be made resilient with the use of foamed polyurethane. The seat can also be made of foam rubber covered with heat sealed vinyl. The softer surface on the seat provides added safety in the bathroom.

While there have been shown and described preferred embodiments of the invention, it is understood that various changes in size, materials and design may be made by those skilled in the art without departing from the invention. The invention is defined in the following claims.

The embodiments of the invention in which an exclusive property or privilege is claimed are defined as follows:

1. A toilet seat comprising: base means defining a narrow, elongate central opening; said base means having side members and a rear member connected to the side members, a pair of mutually opposed support members connected to said side members, said support members projected transversely inward of said central opening and located rearwardly in said opening dividing the opening into a forward opening and a rear opening, said support members being laterally spaced from each other providing an open passage between the forward opening and rear opening and having a width substantially smaller than the width of either the forward or rear openings, said rear member having an upper surface portion adapted to engage and support the base of the spine of a person seated on the seat, each of said support members having an upper surface portion adapted to engage and support an ischium of the person, said upper surface portion of the rear member and the upper surface portions of the support members being located at the corners of a generally triangular outline, said upper surface portions of the support members being inclined inwardly and downwardly in substantially the same elevation and said upper surface portion of the rear member being located in substantially the same elevation of the upper surfaces portions of the support members whereby the base of the spine and the ischia of the person evenly and concurrently engage the upper surface portions of the rear member and the upper surface portions of the support members, said upper surface portions of said support members being transversely spaced about 3 inches apart, and said upper surface portion of the rear member and each of said upper surface portions of the support members is spaced about 5 inches apart.

2. The seat of claim 1 wherein said ischium support members are integral with said base means.

3. The seat of claim 1 wherein said ischium support members comprise separate elements, and means detachably securing said elements to said base means.

4. The seat of claim 3 wherein said securing means comprises a clamp assembly embracing a portion of said base means.

* * * * *